United States Patent [19]

Shigemizu

[11] Patent Number: 4,512,524

[45] Date of Patent: Apr. 23, 1985

[54] CRUSHER FOR CONCRETE STRUCTURES

[75] Inventor: Akihiko Shigemizu, Tokyo, Japan

[73] Assignees: Takachiho Kogyo Yuugen Kaisha; Kabushiki Kaisha Kansai Kougu Seisakusho, both of Tokyo, Japan

[21] Appl. No.: 551,322

[22] Filed: Nov. 14, 1983

[30] Foreign Application Priority Data

Sep. 16, 1983 [JP] Japan ..... 58-170778

[51] Int. Cl.[3] ..... B02C 1/06

[52] U.S. Cl. ..... 241/101.7; 125/23 R; 225/103; 241/266; 403/164; 414/734; 901/39

[58] Field of Search ..... 241/101.7, 201, 203, 241/285 R, 263–269; 125/23 R, 23 C, 36, 37, 40; 225/103; 212/242; 403/164, 165, 84, 93, 96; 414/729, 734, 735; 901/39

[56] References Cited

U.S. PATENT DOCUMENTS 4,196,862 4/1980 Tagawa ..... 241/101.7

FOREIGN PATENT DOCUMENTS 2340188 3/1974 Fed. Rep. of Germany ... 241/101.7
58-14909 3/1983 Japan .
2024042 1/1980 United Kingdom ..... 241/101.7

*Primary Examiner*—Howard N. Goldberg
*Assistant Examiner*—Joseph M. Gorski
*Attorney, Agent, or Firm*—Frishauf, Holtz, Goodman & Woodward

[57] ABSTRACT

A crusher for concrete structures, having a head carried by a traveling carrier, a rotating base supported by the head concentrically therewith for rotation relative thereto, a pair of hydraulic cylinders pivotally supported at ends by the rotating base and symmetrically disposed, a pair of jaw members pivotally supported by the rotating base and symmetrically disposed, and click-stop means provided between the head and the rotating base, the hydraulic cylinders being drivingly coupled to the respective jaw members. The rotating base and the head are coupled to each other by a rotative coupling arrangement comprising first and second disc members disposed in face-to-face engagement with each other, synthetic resin-made bearing members, and stopper means for preventing disengagement of the second disc member from the first disc member. The hydraulic cylinders and the jaw members are each supported by a pair of fulcrums provided on the rotating base at locations symmetrical with respect to the axis of the rotating base.

10 Claims, 15 Drawing Figures

CRUSHER FOR CONCRETE STRUCTURES

BACKGROUND OF THE INVENTION

This invention relates to a crusher for concrete structures, which is adapted to crush walls, floors, foundations of concrete structures and also adapted to shear iron bars of concrete structures.

Conventional measures for demolishing concrete buildings include explosion by the use of explosives, crushing by the use of machine drills or rock borers utilizing air pressure, falling under the category of hand hammers including sinkers and jack hammers, and crushing by the use of a dropping steel ball. However, explosion by the use of explosives is only possible under limited conditions, while crushing by the use of pneumatic drills, etc. causes large noise, providing a problem of public nuisance. On the other hand, the use of a steel ball for crushing an object requires a large operating space where an associated crane lifts the steel ball up to a high level to drop same against the object through a sufficient dropping stroke to impart sufficient crushing energy to the object.

To solve these problems, a crusher has been developed and used, which comprises a support frame controllable in position by a hydraulic cylinder/link assembly, a pair of crushing claws oppositely disposed and pivotally supported on the support frame, and a hydraulic cylinder interposed between the claws at one side thereof to forcibly open and close the bladed portions of same at the other side, wherein a concrete structure to be crushed is held between the toothed portions of the claws, and the hydraulic cylinder is operated to force the toothed portions to apply pressure to the structure to thereby crush same.

However, according to this conventional crusher, if the hydraulic cylinder is operated when the nipping or toothed faces of the claws engage with the opposite side wall surfaces of a concrete structure obliquely thereto or not parallelly therewith, a torsional force is produced which acts upon the claws to bring their toothed or nipping faces into parallel contact with the opposite side wall surfaces of the concrete structure. As a consequence, the support frame and the hydraulic cylinder/-link assembly also undergo this torsional force, and even can be damaged thereby.

To overcome this disadvantage, a crusher for concrete structures has been proposed by Japanese Pat. Publication No. 58-14909 issued Mar. 23, 1983, which comprises a head carried by a traveling carrier, a rotating base supported by the head concentrically therewith for rotation relative thereto, a pair of hydraulic cylinders pivotally supported at ends by the rotating base and disposed symmetrically with respect to the axis of the rotating base, a pair of jaw members as crushing claws pivotally supported by the rotating base and disposed symmetrically with respect to the axis of the rotating base, and click-stop means provided between the rotating base and the head, the hydraulic cylinders being drivingly coupled to the jaw members. According to this proposed crusher, as the hydraulic cylinders are operated, the rotating base is rotated relative to the head through suitable angles depending upon the initial angle of contact of the jaw members with an object to be crushed, so as to automatically bring the jaw members into a stable angular position where they can apply a maximum crushing load to the crushing object, thereby preventing torsional deformation or breakage of the aforementioned support frame, etc.

However, in this proposed crusher, the coupling means for rotative coupling of the rotating base to the head has rather a rigid or stiff structure comprising a central hole formed through the head, a shaft protruded from one end surface of the rotating base and rotatively penetrating the above central hole, and a retainer ring fitted around the central hole and secured thereto by bolts. It is therefore not well pliable or flexible to loads applied thereto by the hydraulic cylinders and the jaw members during operation. Besides, metal powder is produced by frictional sliding contact between the component parts of the coupling means, which impedes smooth rotation of the rotating base relative to the head. Moreover, the hydraulic cylinders and the jaw members are each pivotally supported by the rotating base by means of a single fulcrum shaft, with the result that loads are concentrated on the single fulcrum shaft to deform same, and can even cause breakage of same. Still further, the two jaw members are asymmetrical in shape with each other and accordingly their common center of gravity is not located just at the middle point between them. As a consequence, it is often difficult to bring the jaw members into biting engagement with a crushing object, especially when the jaw members are inclined with respect to the horizontal line or positioned horizontally.

SUMMARY OF THE INVENTION

It is an object of the invention to provide a crusher for concrete structures, which is provided with rotative coupling means having a sufficiently flexible structure which is highly pliable to loads applied thereto by the jaw members and/or the hydraulic cylinders as well as adapted to always ensure smooth rotation of the rotating base relative to the head during operation of the crusher.

It is a further object of the invention to provide a crusher which is provided with fulcrum shaft means capable of stably supporting the hydraulic cylinders and the jaw members on the rotating base, thereby being free of deformation or breakage.

It is another object of the invention to provide a crusher which is designed such that the common center of gravity of the jaw members is located just at the middle point between them, thereby facilitating biting engagement of them with an object to be crushed.

It is a still further object of the invention to provide a crusher which is provided with means for keeping the jaw members from excessive lateral loads.

The present invention provides improvements in or to a crusher for concrete structures, which includes a head carried by a traveling carrier, a rotating base supported by the head concentrically therewith for rotation relative thereto, a pair of hydraulic cylinders pivotally supported at ends by the rotating base and disposed symmetrically with respect to the axis thereof, a pair of jaw members pivotally supported by the rotating base and disposed symmetrically with respect to the axis thereof, and click-stop means provided between the rotating base and the head for retaining the rotating base in any one of a plurality of predetermined circumferential positions with respect to the head, against a value of load applied on the rotating base or the head below a predetermined value. A primary one of the improvements lies in the rotative coupling means coupling the rotating base with the head, which comprises:

a first disc member forming part of the rotating base, having one side surface provided with a cylindrical hub and extending substantially parallel with a plane perpendicular to the axis of the rotating base; a second disc member forming part of the head and disposed in facing relation to the above one side surface of the first disc member, the second disc member having a boss formed at its center and disposed around the hub of the first disc member; a cover disposed over the hub of the first disc member and the boss of the second disc member; means fixing the cover to the hub of the first disc member; an annular bearing member formed of synthetic resin and interposed between the one side surface of the first disc member and the second disc member; a cylindrical bearing member formed of synthetic resin and interposed between the hub of the first disc member and the boss of the second disc member; and stopper means for keeping the second disc member engaged with the first disc member against disengagement therefrom. The first disc member is thus rotatable relative to the second member through sliding intervention of the bearing members therebetween.

Preferably, the rotative coupling means further includes a second annular bearing member formed of synthetic resin and interposed between a peripheral flange formed on the cover and the second disc member.

Further preferably, the hydraulic cylinders are supported at the above ends on the rotating base by means of a pair of brackets protruded from the other side surface of the first disc member and disposed at diametrically opposite locations thereof, while the jaw members each have one end formed with a through hole aligned with a corresponding one of a pair of through holes which are formed through opposite side walls of a framed portion concentrically secured to the first disc member of the rotating base and disposed symmetrically with respect to the axis of the frame portion, and are supported on the rotating base by means of a pair of fulcrum shafts penetrating through the aligned through holes.

The above and other objects, features and advantages of the invention will be more apparent from the ensuing detailed description taken in conjunction with the accompanying drawings.

DETAILED DESCRIPTION

Figure 1:
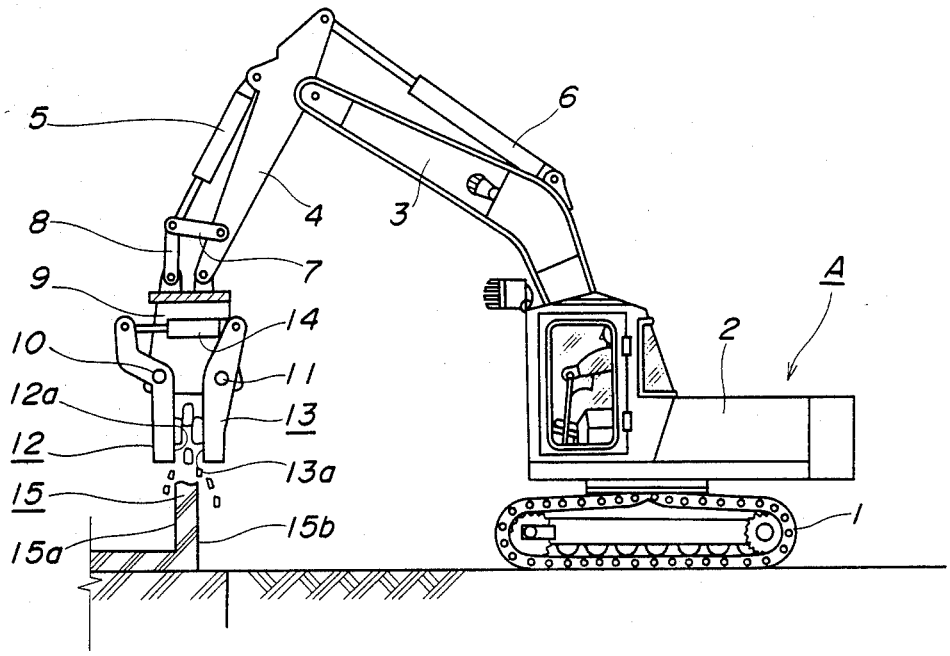
FIG. 1 PRIOR ART
FIG. 1 is a side view of a conventional crusher for concrete structures and a traveling carrier carrying same.
Figure 2:
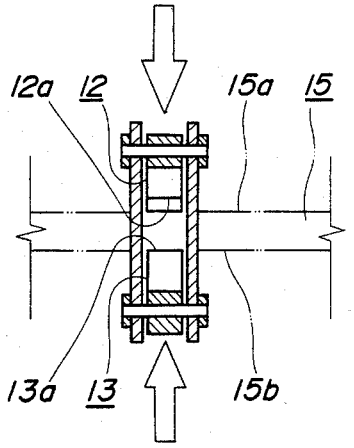
FIG. 2 PRIOR ART
FIG. 2 is a horizontal sectional view of the crushing claws of the crusher in FIG. 1 and a concrete wall to be crushed, disposed in parallel contact with each other.
Figure 3:
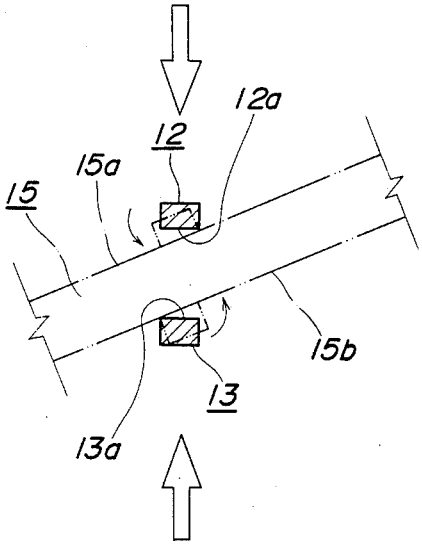
FIG. 3 PRIOR ART
FIG. 3 is a horizontal sectional view of the crushing claws and the concrete wall disposed in oblique or non-parallel contact with each other.
Figure 4:
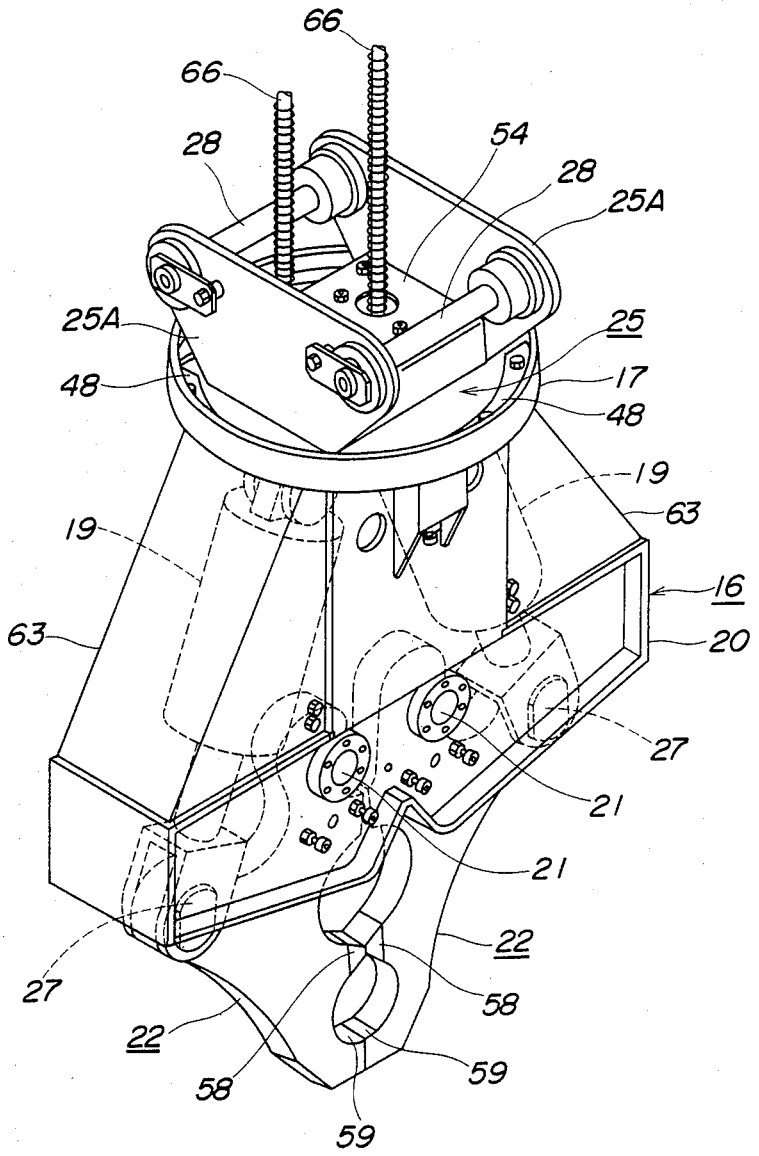
FIG. 4 is a perspective view of a crusher for concrete structures according to an embodiment of the present invention.
Figure 5:
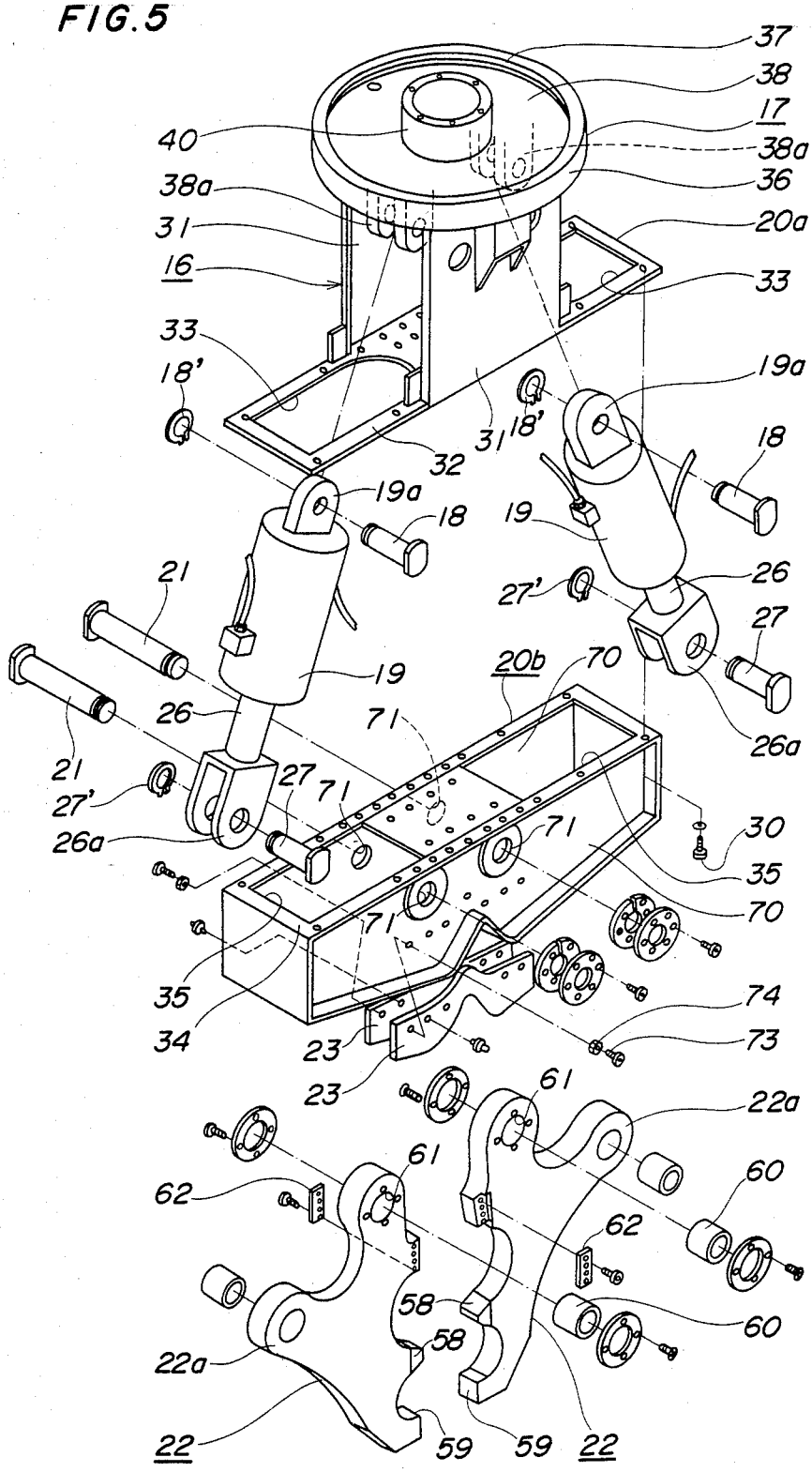
FIG. 5 is an exploded perspective view of the rotating base, jaw members, etc. of the embodiment of FIG. 4.
Figure 6:
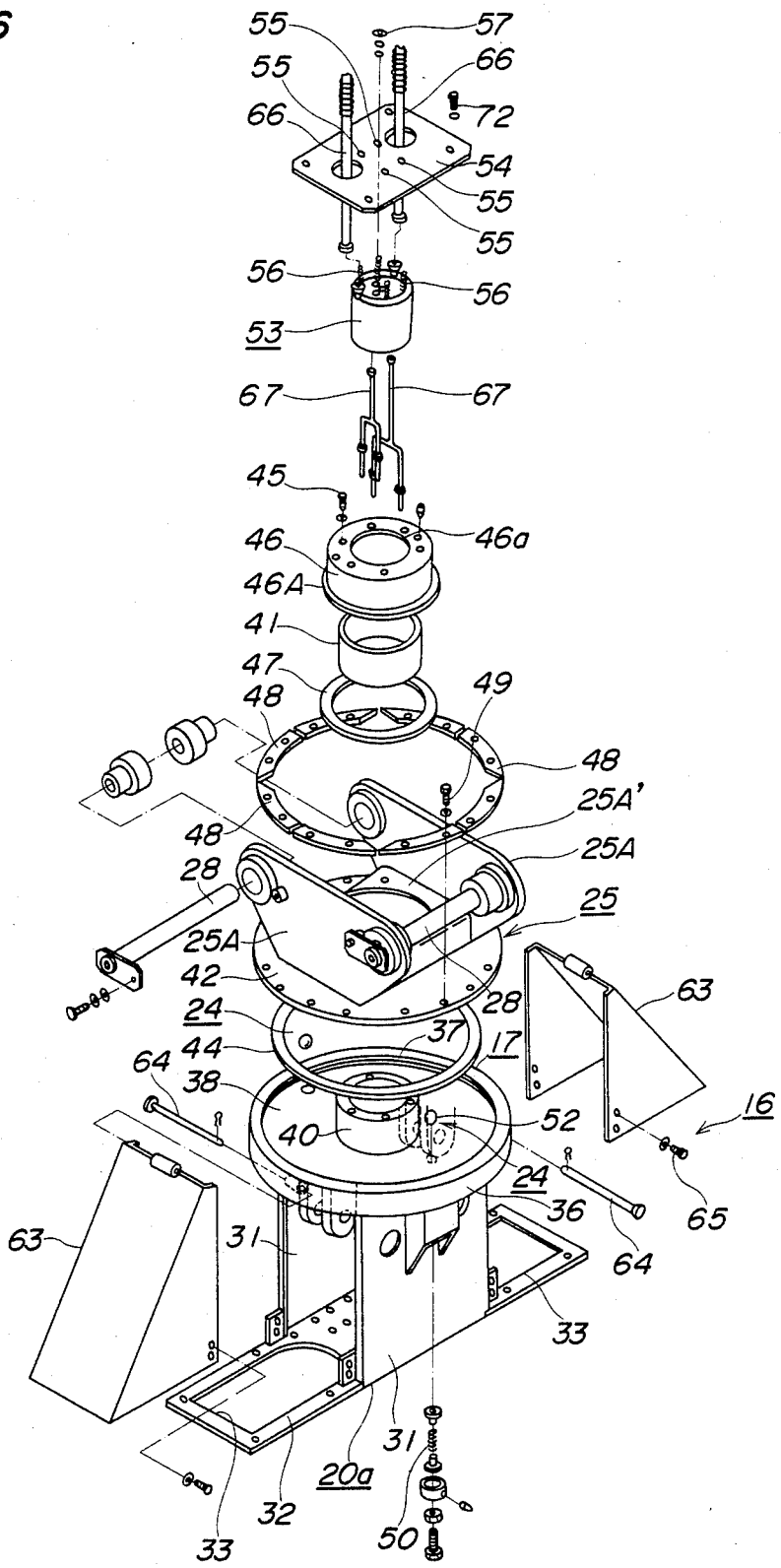
FIG. 6 is an exploded perspective view of the head, an upper half of the rotating base, etc. of the same embodiment.

Referring first to FIGS. 1 through 3, there is shown a crusher conventionally employed for demolishing concrete structures. The crusher is mounted on an arm 4 pivoted to tip of a boom 3 which is vertically pivotally coupled to a revolving super structure 2 mounted on a crawler-type base carrier 1 of a traveling carrier A. The illustrated traveling carrier A substantially corresponds to a crawler-type shovel excavator with its bucket removed. The illustrated conventional crusher comprises a support frame 9 controllable in position by the cooperative actions of hydraulic cylinders 5 and 6 for driving the arm 4, and links 7 and 8, a pair of crushing claws 12 and 13 pivotally supported on the support frame 9 by means of horizontally extending pins 10 and 11, and a hydraulic cylinder 14 interposed between upper half portions of the claws 12, 13. As the hydraulic cylinder 14 is operated, the claws 12, 13 are pivotally displaced to open their lower half portions into gripping engagement with a concrete wall 15 to be crushed, and have their gripping force increased with further operation of the hydraulic cylinder 14 to crush the gripped portions of the concrete wall 15.

With this type crusher, the concrete crushing operation can be performed without noise and vibration.

If the claws 12, 13 are in a stably engaging position where their nipping or gripping faces 12*a* and 13*a* are positioned in parallel or face-to-face contact with the opposite side walls 15*a* and 15*b* of the concrete structure 15 as shown in FIG. 2, the operation of the hydraulic cylinder 14 of applying a large hydraulic pressure upon the claws 12, 13 will have no adverse influence upon the support frame 9, the arm 4, the boom 3, the revolving super structure 2, etc. However, if the claws 12, 13 are in an unstably engaging position where their nipping faces 12*a*, 13*a* are in oblique or non-parallel contact with the side surfaces 15*a*, 15*b* of the concrete wall 15 as shown in FIG. 3, the operation of the hydraulic cylinder 14 of applying a large hydraulic pressure upon the claws 12, 13 will cause reaction forces in the concrete wall 15 to bring the nipping faces 12*a*, 13*a* into face-to-face contact with the side surfaces 15*a*, 15*b* of the concrete wall 15 as indicated by the arrows in FIG. 3. This in turn causes a torsional force acting upon the support frame 9, the arm 4, the boom 3, and the revolving super structure 2, which are joined together with sufficient rigidity, to swing them in the direction in which the claws 12, 13 are acted upon by the reaction forces. In practice, the base carrier 1 and the revolving super structure 2, which have very large weights, will rarely be swung by such torsional force, but torsion or even torsional breakage will occur in one or more of the pins 10, 11 as fulcrums for the claws 12, 13, the support frame 9, the arm 4, and the boom 3.

Therefore, the operator has to set the position of the base carrier 1 so as to avoid the oblique or non-parallel contact of the claws 12, 13 with the side surfaces 15*a*, 15*b* of the concrete wall 15, which results in low working efficiency.

The present inventor has made researches to solve the above problem and has reached the recognitions that torsion or torsional breakage of the pins 10, 11, the support frame 9, the arm 4, the boom 3, etc. can be prevented if the support frame 9 is freely rotatable about an axis passing the middle point between the fulcrums of the claws 12, 13 when a value of load exceeding a predetermined value acts upon the claws, and the claws can be easily and positively brought into biting engagement with an object to be crushed if the common center of gravity of the claws is located at the middle point between the claws.

The present invention is based upon the above recognitions, a preferred embodiment of which will now be described in detail with reference to FIGS. 4 through 15. As shown in FIGS. 4 through 11, a crusher for concrete structures according to the invention comprises basic elements of: a head 25 which can be supported on the traveling carrier A in FIG. 1 by means of the hydraulic cylinder/link assembly 3–8 in FIG. 1; a rotating base 16 coupled to one side of the head 25 concentrically therewith for rotation relative thereto; a pair of hydraulic cylinders 19 and 19 pivotally supported at ends by the rotating base 16 and disposed symmetrically with respect to the axis of the rotating base 16; a pair of jaw members 22 and 22 pivotally supported by the rotating base 16 and disposed symmetrically with respect to the axis of the rotating base 16, and to which the piston rods at the other ends of the hydraulic cylinders 19, 19 are drivingly coupled; and click-stop means provided between the head 25 and the rotating base 16 for holding the rotating base 16 in any one of a plurality of predetermined circumferential positions relative to the head 25 against a value of load applied thereon below a predetermined value.

The above-mentioned basic construction is substantially identical with that of the crusher disclosed by Japanese Pat. Publication No. 58-14909 referred to hereinbefore.

Details of the structural features proper to the present invention will now be explained. The rotating base 16 is formed of an upper portion 17 having a generally disc-shaped configuration as a first disc member and extending parallel with a plane perpendicular to the axis of the rotating base 16, and a lower portion 20 composed of an upper framed half 20*a* and a lower framed half 20*b* and concentrically combined with the upper portion 17. The upper and lower framed halves 20*a*, 20*b* are integrally joined together by means of a plurality of bolts 30. The disc-shaped upper portion 17 comprises a peripheral wall 36 having an annular flange 37 radially inwardly projected therefrom, and a base disc 38 formed integrally with the peripheral wall 36 and disposed in spaced and facing relation to the annular flange 37. The base disc 38 has a cylindrical hub 40 disposed on its upper side surface concentrically with a central hole 39 formed therethrough. The cylindrical hub 40 is secured to the base disc 38 by means of welding. A pair of bifurcated brackets 38*a* and 38*a* for mounting the hydraulic cylinders 19, 19 on the base disc 38 are secured to the lower side surface of the base disc 38 by means of welding and disposed at diametrically opposite locations of the disc 38. The upper framed half 20*a* of the lower portion 20 comprises two opposite vertical wall plates 31 and 31 secured at upper ends to the lower side surface of the base disc 38 by welding, and a plate 32 welded to the lower ends of the vertical wall plates 31, 31 and formed with two rectangular openings 33 and 33 through which the hydraulic cylinders 19, 19 extend. The lower framed half 20*b* of the lower portion 20 comprises a single-piece framework having a ceiling wall 34 formed with two openings 35 and 35 through which the hydraulic cylinders 19, 19 extend respectively, and two opposite side wall plates 70 and 70 secured to the framework. The side wall plates 70, 70 are each formed with through holes 71 and 71 disposed symmetrically with respect to the axis of the lower framed half 20*b* and through which fulcrum shafts 21 and 21, hereinafter referred to, extend to mount the respective jaw members 22, 22 on the lower framed half 20*b*.

The hydraulic cylinders 19, 19 are pivotally coupled to the rotating base 16 in such a manner that plate-like mounting brackets 19*a* and 19*a* integral with upper ends of the cylinders 19, 19 engage in an aligned manner with the respective mounting brackets 38*a*, 38*a* projected from the lower side surface of the base disc 38, and pins 18 and 18 mutually parallelly extend through the aligned brackets 19*a*, 38*a*, with their tips fitted with snap rings 18' and 18' for preventing disengagement of the pins from the brackets. The hydraulic cylinders 19, 19 are also pivotally coupled to the respective jaw members 22, 22 in such a manner that bifurcated mounting brackets 26*a* and 26*a* integral with tips of the pistons 26, 26 at the lower ends of the cylinders engage in an aligned manner with coupling portions 22*a* and 22*a* of the jaw members 22, 22, and pins 27 and 27 mutually parallely extend through the aligned brackets 26*a* and coupling portions 22*a*, with their tips fitted with snap rings 27' and 27' for preventing disengagement of the pins from the brackets.

The head 25 comprises an annular seating disc 42 as a second disc member, having an upwardly extending boss 43 (FIG. 7) formed integrally at its center, a pair of opposite wall portions 25A and 25A axially projected from the seating disc 42 and welded thereto in a manner symmetrical with respect to the axis of the head 25 and spaced from each other by a predetermined distance, and a pair of shafts 28 and 28 penetrating the side wall portions 25A, 25A as well as the end portions of the arm 4 and the link 8 of the traveling carrier A in FIG. 1.

Figure 7:
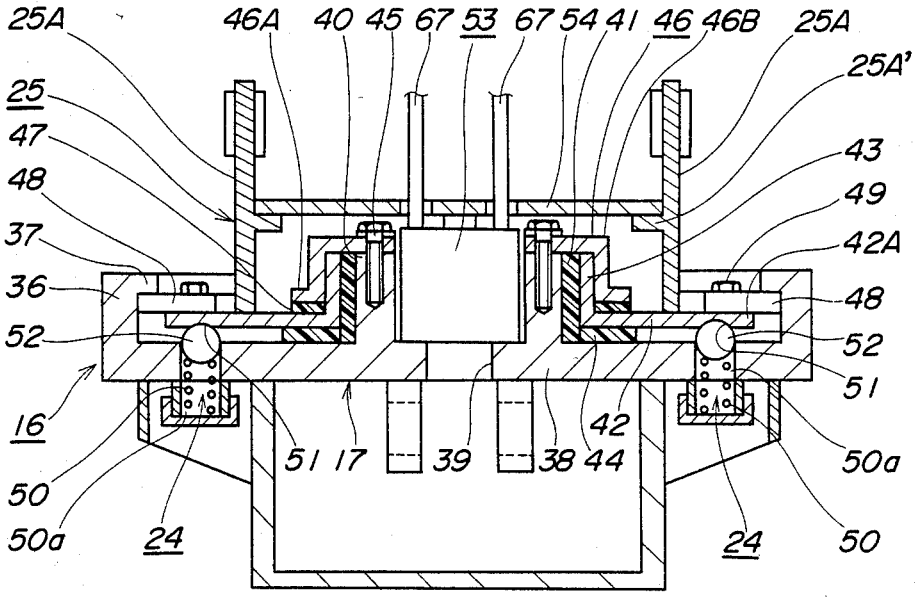
FIG. 7 is a longitudinal sectional view of the rotating base and the head in an assembled state.
Figure 8:
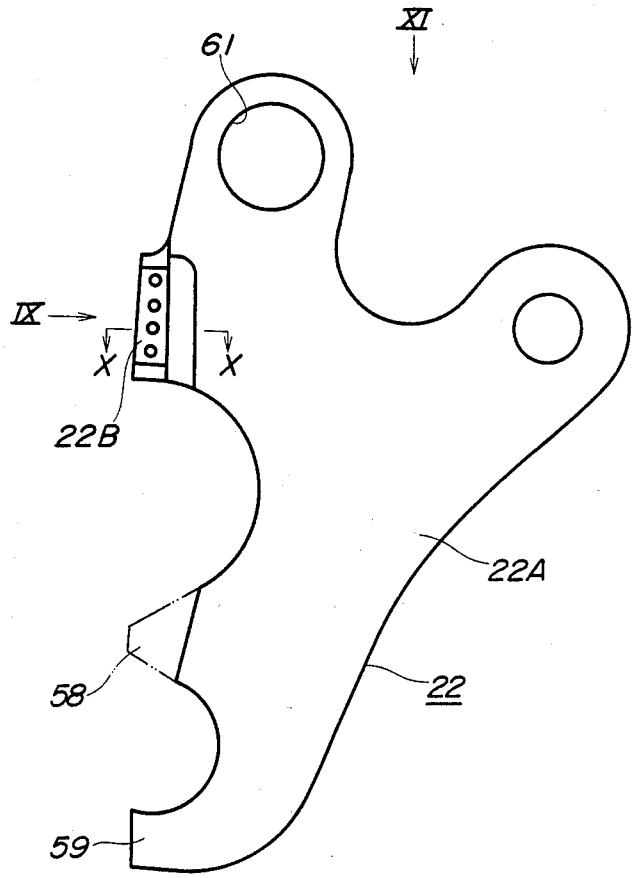
FIG. 8 is a front view of a first example of the jaw member.
Figure 9:
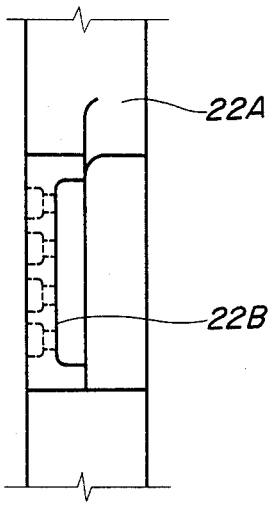
FIG. 9 is an enlarged view as viewed from the side of the arrow IX in FIG. 8.
Figure 10:
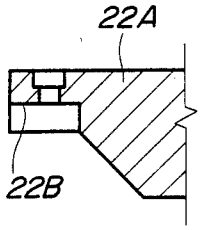
FIG. 10 is an enlarged sectional view taken along line X—X in FIG. 8.
Figure 11:
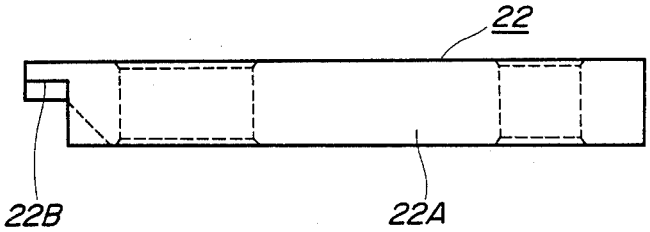
FIG. 11 is a view as viewed from the side of the arrow XI in FIG. 8.

As best shown in FIG. 7, the seating disc 42 of the head 25 is disposed in closely facing and parallel relation to the upper side surface of the base disc 38 of the rotating base 16, with its boss 43 fitted around the hub 40 of the base disc 38. An annular bearing plate 44 formed of synthetic resin, preferably hard nylon, is interposed between the seating disc 42 and the upper side surface of the base disc 38, while a cylindrical bearing member 41 also formed of synthetic resin, preferably hard nylon, is interposed between the boss 43 and the hub 40. In this way, the base disc 38 is slidably rotatable relative to the seating disc 42 via the bearing members 44 and 41 interposed therebetween. The outer diameter of the seating disc 42 is set at a value slightly smaller than the inner diameter of the inner peripheral edge of the annular flange 37 of the rotating base 16 to facilitate inserting the seating disc 42 into the rotating base 16 through the annular flange 37. The seating disc 42 has its peripheral edge 42A located between the annular flange 37 and the base disc 38, and a plurality of arcuate stopper plates 48 are interposed in an annular or circular array between the peripheral edge 42A and the annular flange 37 and secured to the seating disc 42 by means of a plurality of bolts 49.

A cover 46 in the form of a cap having a central opening **46*a* is disposed over the hub 40 of the base disc 38 and the boss 43 of the seating disc 42 and secured to the hub 40 by means of two bolts 45. The cover 46 has its bottom portion 46B disposed in urging contact with the upper end faces of the hub 40 of the base disc 38 and the boss 43 of the seating disc 42, and its peripheral flange 46A with the outer peripheral surface of the boss 43, respectively. Interposed between the lower surface of the flange 46A and a surface of the seating disc 42 facing the same is an annular bearing plate 47** also formed of synthetic resin, preferably hard nylon.

Click-stop means 24 is interposed between the base disc 38 of the rotating base 16 and the seating disc 42 of the head 25 to stably hold the rotating base 16 in any one of predetermined circumferential positions relative to the head 25 so long as a load is applied to the base disc 38 or the head, which has a value below predetermined value. The click-stop means 24 comprises two through holes **50*a* formed through the base disc 38 at diametrically opposite locations, a plurality of recesses 51 formed in the lower side surface of the seating disc 42 of the head 25 at predetermined circumferential positions and circumferentially spaced from each other, two steel balls 52 each stably held between a corresponding one of the through holes 50*a* and any one of the recesses 51 in a manner being forcedly disengageable from the same recess 51, and two coil springs 50 mounted within respective ones of the through holes 50*a* and each urging the corresponding ball 52 against any one of the recesses 51** facing the same ball.

A swivel joint 53 is rotatably mounted in the hub 40 of the base disc 38. A mounting plate 54 is placed on support shelves 25A' and 25A' integral with the inner wall surfaces of the opposite walls 25A, 25A of the head 25 and secured thereto by means of screws 72. The swivel joint 53 is supportedly secured at its upper side surface to the mounting plate 54 by means of stud bolts 56 erected on the same upper surface and extending through a plurality of through holes 55 in the mounting plate 54, and nuts 57 screwed on the bolts.

Hydraulic operating fluid conduits 66 and 66 upwardly extend from the upper side surface of the swivel joint 53 and are connected to hydraulic control means, not shown, while hydraulic operating fluid conduits 67 and 67 are connected to different ones of the conduits 66, 66 and downwardly extend from the lower side surface of the swivel joint 53, one of which conduits 67 is connected to one side of the piston, not shown, of each of the hydraulic cylinders 19, 19, and the other to the other side of the piston, respectively, for supply and return of hydraulic operating fluid to and from the hydraulic cylinders.

The jaw members 22, 22 as crushing claws are identical in shape and size with each other, details of which are illustrated in FIGS. 8 through 11. The body 22A of each of the jaw members has a side surface facing the other jaw member and provided with a toothed portion 58 joined thereto by means of build-up welding at a relatively high level, and another toothed portion 59 formed integrally with the body 22A at a relatively low level. A through hole 61 is formed through an upper end of the above mutually facing side surface, through which is fitted a bearing sleeve 60 for one of the fulcrum shafts 21 to extend through it. This through hole 61 is aligned with one pair of the through holes 71 in the lower framed portion **20*b* of the rotating base 16 to pivotally couple the jaw member 22 on the rotating base 16 by one of the fulcrum shafts 21 extending through the aligned holes 61, 71. The above mutually facing side surface of each jaw member 22 is also formed with a stepped shoulder 22B in the vicinity of the through hole 61, on which is removably rigidly mounted a separate blade 62** for shearing iron bars or the like.

The thrust plates 23, 23 are rigidly fastened to the inner surfaces of the lateral side walls 70, 70 of the lower framed half **20*b* of the lower portion 20 of the rotating base 16 by means of bolts 73 and nuts 74 and held in sliding contact with the lateral side walls of the respective jaw members 22, 22** to laterally bear them.

Two covers 63 and 63 for the hydraulic cylinders 19, 19 are pivoted at upper ends to the lower side surface of the base disc 38 of the upper portion 17 of the rotating base 16 by means of fulcrum rods 64 and 64, and secured at lower ends to the lower portion **20*a* by means of bolts 65**.

The crusher for concrete structures according to the invention constructed as above is mounted at its head 25 on the arm 4 and link 8 of the traveling carrier A in FIG. 1 by means of fulcrum shafts 28, 28 as stated hereinbefore. As hydraulic operating fluid is supplied to and returned from the hydraulic cylinders 19, 19 through the conduits 66, 67, the jaw members 22, 22 supported on the rotating base 16 by the fulcrum shafts 21, 21 are closed and opened, and when closed, their toothed portions 58, 59 are forced to crush a concrete structure.

Iron bars exposed from the concrete structure are sheared off by the blades 62, 26 of the jaw members 22, 22.

During the demolishing operation, the opened jaw members 22, 22 are first brought into gripping engagement with a concrete structure to be crushed, and then the hydraulic cylinders 19, 19 are operated so as to have their hydraulic outputs increased to thereby increase the biting force of the jaw members 22, 22. With this increase in the biting force, the jaw members 22, 22 become angularly displaced so as to have their nipping or biting faces brought into parallel with the opposite crushing surfaces of the concrete structure, where their biting faces are disposed in face-to-face contact with the crushing surfaces of the concrete structure, thereby imparting a large crushing force to the latter. The above angular displacement of the jaw members 22, 22 is allowed by sliding rotation of the base disc 38 of the rotating base 16 relative to the seating disc 42 of the head 25 through the bearing members 41, 44, and 47 interposed therebetween. Therefore, the toothed portions 58, 59 of the jaw members 22, 22 can bitingly engage the crushing surfaces of a concrete structure with their axes at right angles to the same crushing surfaces to thereby transduce the hydraulic pressure of the hydraulic cylinders into the crushing force with maximum efficiency, and without the possibility of an excessive load being applied on the arm 4 and the link 8 coupled to the head 25 to cause torsion or torsional breakage of them.

Further, the click-stop means 24, 24 provided between the head 25 and the rotating base 16 prevent lost motion or idle rotation of the rotating base 16, while enabling positive and smooth angular displacement of the rotating base 16 relative to the head 25 through a suitable angle depending upon the positions of the jaw members 22, 22 relative to the crushing object, thereby facilitating the location of the jaw members with respect to the crushing object.

Moreover, since the separate iron bar-shearing blades 62, which can be more frequently broken than the teeth 58, 59, are removably mounted on the jaw members 22, 22, replacement of the blades 62 with new ones can be effected with ease upon breakage of them, without the need of replacing the whole jaw member with a new one.

Besides the above-mentioned results, the crusher according to the invention provide many excellent proper results as follows:

(i) The rotative coupling means between the head 25 and the rotating base 16 has a flexible or pliable structure wherein the combined seating disc 42 and stopper plates 48, as well as the synthetic resinous bearing members 41, 44 and 47 are moderately elastically deformable in the axial directions, and therefore can well tenaciously withstand even a large magnitude of load applied by the hydraulic cylinders and the jaw members.

(ii) The employment of the synthetic resinous bearing members 41, 44 and 47 in the rotative coupling means has solved the problem of occurrence of metal powder inherent in the aforementioned conventional crusher, and always ensures smooth rotation of the base disc 38 of the rotating base 16 relative to the head 25. In this respect, it has been ascertained by the present inventor that although resious powder is also produced from the bearing members 41, 44 and 47 due to the frictional sliding contacts of them with their peripheral parts during rotation of the rotating base 16, it becomes shortly assimilated to the base material of the same bearing members during the operation of the crusher, having no substantial obstacle to smooth rotation of the rotating base 16.

(iii) Since the hydraulic cylinders 19, 19 and the jaw members 22, 22 are supported on the rotating base 16, respectively, by two fulcrum shafts 18, 18, and two fulcrum shafts 21, 21 which are arranged symmetrically with respect to the axis of the crusher, there is almost no possibility of these fulcrum shafts being deformed or broken by loads applied thereto, and in addition, the hydraulic cylinders and the jaw members are well dynamically balanced, making the operations of them smooth.

(iv) Since two jaw members identical in shape and size are arranged in symmetry with respect to the axis of the crusher, their common center of gravity is located at the middle point therebetween, preventing lost motion or idle rotation of the jaw members and allowing positive and smooth biting engagement of them with an object to be crushed.

(v) The provision of the thrust plates 23, 23 in sliding and urging contact with the jaw members enables the latter to withstand a large load laterally applied to the jaw members, thereby prolonging the effective lives of the jaw members.

Figure 13:
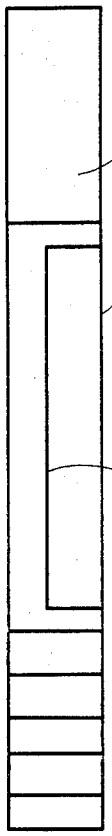
FIG. 13 is a view as viewed from the side of the arrow XIII in FIG. 12.
Figure 12:
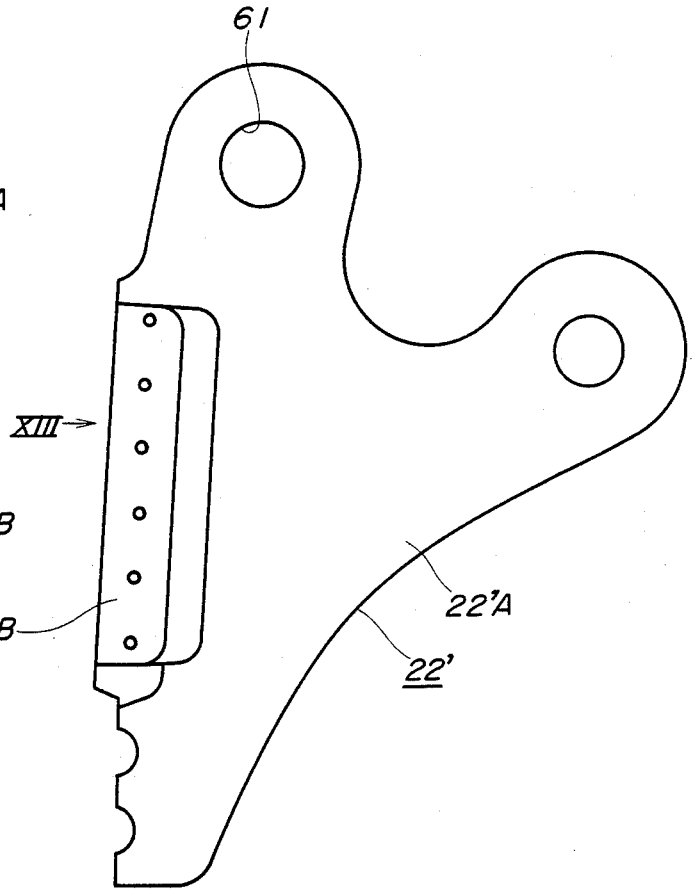
FIG. 12 is a front view of another example of the jaw member, which is used for demolishing concrete foundations.

FIGS. 12 and 13 illustrate anothe example of the jaw members applicable to the crusher of the invention. The jaw member 22' according to this example is intended to mainly shear iron bars or other hard materials, and to this end, has a larger stepped shoulder 22'B formed on its body 22'A. The blades 62, 62 mounted on the jaw members 22', 22' can first hold iron bars, etc. therebetween in a biting manner and then shear them, thereby performing the shearing operation with high efficiency.

Figure 15:
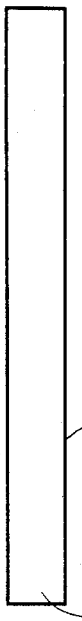
FIG. 15 is a view as viewed from the side of the arrow XV in FIG. 14.
Figure 14:
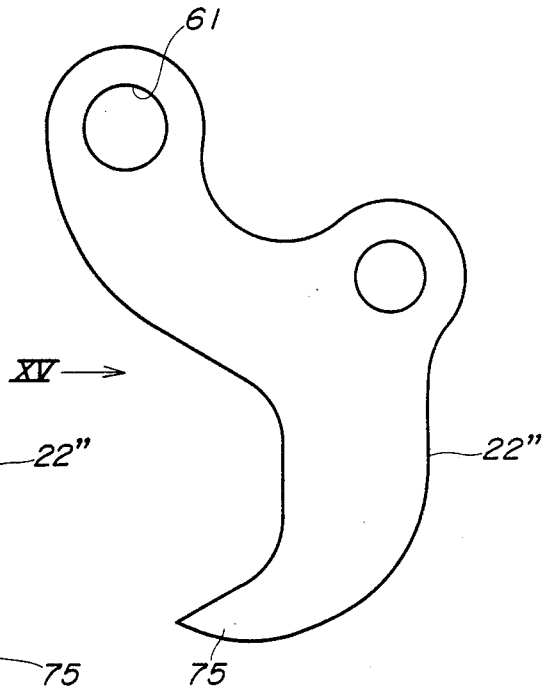
FIG. 14 is a front view of a further example of the jaw member.

FIGS. 14 and 15 illustrate a still further example of the jaw members. The jaw member 22" of this example, which has to be wholly replaced with a new one when broken as distinct from the previous examples, is intended to crush concrete foundations, and the lower pointed portions 75 of the jaw members 22" are thrusted into opposite wall surfaces of a concrete foundation to force the foundation to split into pieces.

While a preferred embodiment has been described, variations thereto will occur to those skilled in the art within the scope of the present inventive concepts which are delineated by the following claims.

What is claimed is:

1. In a crusher for concrete structures, including a head carried by a traveling carrier, a rotating base having an axis and supported by said head concentrically therewith for rotation relative thereto, a pair of hydraulic cylinders pivotally supported at one end by said rotating base and disposed symmetrically with respect to the axis thereof, a pair of jaw members pivotally supported by said rotating base and disposed symmetrically with respect to the axis thereof, and click-stop means provided between said rotating base and said head for retaining said rotating base in any one of a plurality of predetermined circumferential positions with respect to said head, against a value of load applied on at least one of said rotating base and the head below a predetermined value, the improvement comprising rotative coupling means coupling said rotating base with said head, said rotative coupling means comprising: a first disc member forming part of said rotating base and having one side surface provided with a cylindrical hub, said first disc member extending substantially parallel with a plane perpendicular to the axis of said rotating base; a second disc member forming part of said head and disposed in facing relation to said one side surface of said first disc member, said second disc member having a boss formed at a center thereof and disposed around said hub of said first disc member; a cover disposed over said hub of said first disc member and said boss of said second disc member; means fixing said cover to said hub of said first disc member; an annular bearing member formed of synthetic resin and interposed between said one side surface of said first disc member and said second disc member; a cylindrical bearing member formed of synthetic resin and interposed between said hub of said first disc member and said boss of said second disc member; and stopper means for keeping said second disc member engaged with said first disc member against disengagement therefrom, wherein said first disc member is rotatable relative to said second member through sliding intervention of said annular and cylindrical bearing members therebetween.

2. A crusher for concrete structures, as claimed in claim 1, wherein said cover has a peripheral flange disposed in facing relation to said second disc member, said rotative coupling means further including a second annular bearing member formed of synthetic resin and interposed between said peripheral flange of said cover and said second disc member.

3. A crusher for concrete structures, as claimed in claim 1, wherein said first disc member has a peripheral wall formed with a radially inwardly extending annular flange, and a base disc disposed in facing and spaced relation to said annular flange, said second disc member having a peripheral portion thereof located between said annular flange of said peripheral wall and said base disc of said first disc member, said stopper means being secured to said peripheral portion of said second disc member for keeping said second disc member from disengagement from said first disc member.

4. A crusher for concrete structures, as claimed in claim 3, wherein said stopper means comprises a plurality of arcuate stopper plates arranged on said peripheral portion of said second disc member in a circular array.

5. A crusher for concrete structures, as claimed in claim 3, wherein said click-stop means comprises at least one hole formed in said base disc of said first disc member, a plurality of recesses formed in said peripheral portion of said second disc member at predetermined circumferential positions, at least one ball interposed between said hole and any one of said recesses in a manner disengageable from said any one of said recesses, and a spring mounted in said hole and urging said ball against said any one of said recesses.

6. A crusher for concrete structures, as claimed in claim 1, including coupling means coupling said rotating base with said hydraulic cylinders, said coupling means comprising a pair of first mounting brackets projected from another side surface of said first disc member of said rotating base and disposed at diametrically opposite locations thereof, a pair of second mounting brackets each provided on said one end of each of said hydraulic cylinders and engaging a corresponding one of said first mounting brackets, and a pair of pins penetrating respective pairs of said first and second mounting brackets engaging with each other.

7. A crusher for concrete structures, as claimed in claim 1, wherein said rotating base includes a first framed portion secured to another side surface of said first disc member concentrically therewith, a second framed portion secured to said first framed portion concentrically therewith and having opposite side walls and an axis, said crusher including coupling means coupling said jaw members with said rotating base, said coupling means comprising a pair of through holes formed through each of said opposite side walls of said second framed portion and disposed symmetrically with respect to the axis of said second framed portion, a second through hole formed through each of said jaw members at a predetermined location thereof and aligned with a corresponding one of said first through holes of said second framed portion, and a pair of fulcrum shafts extending through said first and second through holes aligned with each other and pivotally coupling said each jaw member to said framed portion.

8. A crusher for concrete structures, as claimed in claim 7, including a pair of thrust plates secured to respective ones of said opposite side walls of said second framed portion of said rotating base and disposed in slidable contact with respective ones of said jaw members for bearing loads laterally applied thereto.

9. A crusher for concrete structures, as claimed in claim 1, wherein said pair of jaw members are identical in shape and size with each other and disposed symmetrically with each other.

10. A crusher for concrete structures, as claimed in claim 1, including a swivel joint rotatably mounted in said hub of said first disc member, a pair of first conduits connected with each other by said swivel joint for supplying hydraulic fluid to said jaw members, and a pair of second conduits connected with each other by said swivel joint for returning hydraulic fluid drained from said jaw members.

* * * * *